US010712123B2

(12) United States Patent
Williams

(10) Patent No.: US 10,712,123 B2
(45) Date of Patent: Jul. 14, 2020

(54) FREE FLOATING HANDGUARD ANCHORING SYSTEM

(71) Applicant: Springfield, Inc., Geneseo, IL (US)

(72) Inventor: Charles David Williams, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 16/517,847

(22) Filed: Jul. 22, 2019

(65) Prior Publication Data

US 2020/0103200 A1 Apr. 2, 2020

Related U.S. Application Data

(63) Continuation of application No. 16/003,171, filed on Jun. 8, 2018, now Pat. No. 10,401,122.

(60) Provisional application No. 62/517,133, filed on Jun. 8, 2017.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16
See application file for complete search history.

(56) References Cited

U.S. PATENT DOCUMENTS

| | | | |
|---|---|---|---|
| 282,194 | A | 7/1883 | Howe |
| 496,231 | A | 4/1893 | Richard et al. |
| 541,560 | A | 6/1895 | Lyman |
| 802,279 | A | 10/1905 | Frommer |
| 861,939 | A | 7/1907 | Benet |
| 1,065,341 | A | 6/1913 | Browning |
| 1,125,937 | A | 1/1915 | Benet |
| 1,143,170 | A | 6/1915 | Browning |
| 1,150,756 | A | 8/1915 | Gocke |
| 1,266,087 | A | 5/1918 | Williams |
| 1,474,209 | A | 11/1923 | Reynolds |
| 1,517,328 | A | 12/1924 | Weiss |
| 2,364,487 | A | 12/1944 | Swartz |
| 2,779,119 | A | 1/1957 | Fawcett |
| 2,902,933 | A | 9/1959 | Moldofsky |
| 2,951,424 | A | 9/1960 | Stoner |

(Continued)

FOREIGN PATENT DOCUMENTS

| | | | |
|---|---|---|---|
| CA | 2612519 | A1 | 12/2006 |
| CA | 2616472 | A1 | 2/2007 |

(Continued)

OTHER PUBLICATIONS

US 8,561,336 B2, 10/2013, Gomez (withdrawn)

(Continued)

*Primary Examiner* — Gabriel J. Klein
(74) *Attorney, Agent, or Firm* — Woodard, Emhardt, Henry, Reevees & Wagner, LLP

(57) ABSTRACT

Handguard anchoring systems suitable for attaching a handguard to a firearm are disclosed, including systems having a fastener that extends into a barrel nut and compresses at least a portion of the handguard between the fastener and the barrel nut. Many embodiments include openings in the handguard and/or a plate that are oversized for the fastener such that the handguard may be rotated relative to the barrel nut when a portion of the fastener is positioned within the opening.

19 Claims, 12 Drawing Sheets

(56) References Cited

U.S. PATENT DOCUMENTS

| | | | |
|---|---|---|---|
| 3,075,314 | A | 1/1963 | Bakker |
| 3,198,076 | A | 8/1965 | Stoner |
| 3,543,429 | A | 12/1970 | Bendele |
| 3,721,031 | A | 3/1973 | Fletcher |
| 3,793,922 | A | 2/1974 | Frielich |
| 4,090,305 | A | 5/1978 | Cassidy |
| 4,304,061 | A | 12/1981 | Brouthers |
| 4,742,636 | A | 5/1988 | Swan |
| 4,765,224 | A | 8/1988 | Morris |
| D30,016 | S | 3/1989 | Baldus |
| 4,841,657 | A | 6/1989 | Mossberg |
| 4,845,871 | A | 7/1989 | Swan |
| 5,142,806 | A | 9/1992 | Swan |
| 5,198,600 | A | 3/1993 | E'Nama |
| 5,225,615 | A | 7/1993 | Talbot |
| 5,276,988 | A | 1/1994 | Swan |
| 5,343,650 | A | 9/1994 | Swan |
| 5,412,895 | A | 5/1995 | Krieger |
| 5,553,329 | A | 7/1996 | Swan |
| RE35,381 | E | 11/1996 | Rose |
| 5,590,585 | A | 1/1997 | Mooney |
| 5,595,602 | A | 1/1997 | Harlan |
| 5,661,255 | A | 8/1997 | Webb, III |
| 5,729,927 | A | 3/1998 | Shaver |
| 5,740,626 | A | 4/1998 | Schuetz |
| 5,826,363 | A | 10/1998 | Olson |
| 6,044,748 | A | 4/2000 | Westrom |
| 6,293,040 | B1 | 9/2001 | Luth |
| 6,295,751 | B1 | 10/2001 | Piwonski |
| 6,321,477 | B1 | 11/2001 | Watson, Jr. |
| 6,345,464 | B1 | 2/2002 | Kim |
| 6,418,655 | B1 | 7/2002 | Kay |
| 6,490,822 | B1 | 12/2002 | Swan |
| 6,499,245 | B1 | 12/2002 | Swan |
| 6,508,027 | B1 | 1/2003 | Kim |
| 6,606,812 | B1 | 8/2003 | Gwinn, Jr. |
| 6,618,976 | B1 | 9/2003 | Swan |
| 6,634,128 | B1 | 10/2003 | Vastag |
| 6,671,990 | B1 | 1/2004 | Booth |
| 6,694,660 | B1 | 2/2004 | Davies |
| 6,769,209 | B2 | 8/2004 | Mendoza-Orozco |
| 6,848,351 | B1 | 2/2005 | Davies |
| 6,854,206 | B2 | 2/2005 | Oz |
| 6,860,053 | B2 | 3/2005 | Christiansen |
| 6,895,708 | B2 | 5/2005 | Kim |
| 6,959,509 | B2 | 11/2005 | Vais |
| 7,059,076 | B2 | 6/2006 | Stoner |
| RE39,465 | E | 1/2007 | Swan |
| 7,204,052 | B2 | 4/2007 | Swan |
| 7,216,451 | B1 | 5/2007 | Troy |
| RE40,216 | E | 4/2008 | Swan |
| 7,356,962 | B2 | 4/2008 | Swan |
| 7,363,741 | B2 | 4/2008 | DeSomma |
| 7,458,179 | B2 | 12/2008 | Swan |
| 7,464,496 | B1 | 12/2008 | Davies |
| 7,493,721 | B2 | 2/2009 | Swan |
| 7,523,580 | B1 | 4/2009 | Tankersley |
| 7,584,567 | B1 | 9/2009 | DeSomma |
| 7,640,689 | B2 | 1/2010 | Fluhr |
| 7,676,975 | B2 | 3/2010 | Phillips |
| 7,707,762 | B1 | 5/2010 | Swan |
| 7,716,865 | B2 | 5/2010 | Daniel |
| 7,757,422 | B1 | 7/2010 | Swan |
| 7,757,423 | B1 | 7/2010 | Swan |
| 7,775,150 | B2 | 8/2010 | Hochstrate |
| 7,770,317 | B1 | 9/2010 | Tankersley |
| 7,793,452 | B1 | 9/2010 | Samson |
| 7,827,722 | B1 | 11/2010 | Davies |
| 7,905,041 | B1 | 3/2011 | Davies |
| D63,768 | S | 5/2011 | Kimmel |
| 7,941,959 | B1 | 5/2011 | Swan |
| 7,963,203 | B1 | 6/2011 | Davies |
| 8,028,456 | B2 | 10/2011 | Peterson |
| 8,028,460 | B2 | 10/2011 | Williams |
| 8,037,633 | B1 | 10/2011 | Troy |
| 8,037,806 | B2 | 10/2011 | Davies |
| 8,046,949 | B1 | 11/2011 | Daniel |
| 8,051,595 | B2 | 11/2011 | Hochstrate |
| 8,069,604 | B2 | 12/2011 | LaRue |
| 8,087,194 | B1 | 1/2012 | Vuksanovich |
| 8,141,285 | B2 | 3/2012 | Brown |
| 8,141,287 | B2 | 3/2012 | Dubois |
| 8,141,289 | B2 | 3/2012 | Gomez |
| 8,201,353 | B1 | 6/2012 | Swan |
| 8,205,373 | B1 | 6/2012 | Ubl |
| 8,230,633 | B1 | 7/2012 | Sisk |
| 8,230,634 | B1 | 7/2012 | Davies |
| 8,234,809 | B2 | 8/2012 | Daniel |
| 8,240,074 | B2 | 8/2012 | Vuksanovich |
| 8,276,303 | B2 | 10/2012 | Kapusta |
| 8,276,304 | B2 | 10/2012 | Samson |
| 8,307,751 | B2 | 11/2012 | Adolphsen |
| 8,316,574 | B1 | 11/2012 | Swan |
| 8,336,243 | B2 | 12/2012 | Langevin |
| 8,347,540 | B2 | 1/2013 | Sirois |
| 8,359,779 | B2 | 1/2013 | Daniel |
| 8,397,416 | B2 | 3/2013 | Laney |
| 8,429,845 | B1 | 4/2013 | Swan |
| 8,448,367 | B2 | 5/2013 | Samson |
| 8,453,364 | B2 | 6/2013 | Kucynko |
| 8,464,457 | B2 | 6/2013 | Troy |
| 8,468,929 | B2 | 6/2013 | Larson |
| 8,528,246 | B2 | 9/2013 | Telles |
| 8,561,335 | B2 | 10/2013 | Brown |
| 8,578,642 | B2 | 11/2013 | Troy |
| 8,595,970 | B2 | 12/2013 | Picciotta |
| 8,601,734 | B1 | 12/2013 | Hopkins |
| 8,607,490 | B1 | 12/2013 | Zinsner |
| 8,806,792 | B2 | 1/2014 | Yan |
| 8,640,372 | B2 | 2/2014 | Hochstrate |
| 8,667,882 | B1 | 3/2014 | Larson |
| 8,667,883 | B1 | 3/2014 | Larson |
| 8,689,477 | B2 | 4/2014 | Gomez |
| 8,689,478 | B2 | 4/2014 | Patel |
| 8,707,850 | B1 | 4/2014 | Davies |
| 8,713,838 | B2 | 5/2014 | Ubl |
| 8,726,557 | B2 | 5/2014 | Stone |
| 8,726,558 | B1 | 5/2014 | Nason |
| 8,726,559 | B1 | 5/2014 | Mueller |
| 8,739,448 | B2 | 6/2014 | Kimmel et al. |
| 8,739,449 | B2 | 6/2014 | Patel |
| 8,769,853 | B1 | 7/2014 | LaRue |
| 8,776,420 | B2 | 7/2014 | Langevin |
| 8,782,943 | B2 | 7/2014 | Jarboe |
| 8,783,160 | B2 | 7/2014 | Hochstrate |
| 8,806,793 | B2 | 8/2014 | Daniel |
| 8,819,980 | B2 | 9/2014 | Geissele |
| 8,839,545 | B1 | 9/2014 | Gangl |
| 8,844,186 | B2 | 9/2014 | LeClair |
| RE45,185 | E | 10/2014 | Davies |
| 8,863,426 | B1 | 10/2014 | Zinsner |
| 8,904,691 | B1 | 12/2014 | Kincel |
| 8,919,025 | B2 | 12/2014 | Kucynko |
| 8,931,196 | B1 | 1/2015 | LaRue |
| 8,985,007 | B2 | 3/2015 | Larson |
| 8,991,092 | B2 | 3/2015 | Shipman |
| 9,003,686 | B2 | 4/2015 | Brown |
| 9,010,009 | B2 | 4/2015 | Buxton |
| 9,032,659 | B1 | 5/2015 | Duneman |
| 9,140,506 | B2 | 9/2015 | Gomez |
| 9,140,520 | B2 | 9/2015 | Lopes |
| 9,157,697 | B2 | 10/2015 | LeClair |
| 9,200,867 | B1 | 12/2015 | Swan |
| 9,212,865 | B2 | 12/2015 | Dubreuil |
| 9,228,799 | B2 | 1/2016 | Kucynko |
| 9,234,717 | B2 | 1/2016 | Jarboe |
| 9,279,632 | B2 | 3/2016 | Hochstrate |
| 9,279,638 | B2 | 3/2016 | Adair |
| 9,279,639 | B2 | 3/2016 | Hines |
| 9,297,609 | B2 | 3/2016 | Burt |
| 9,303,949 | B1 | 4/2016 | Oglesby |
| 9,322,609 | B2 | 4/2016 | Davies |
| 9,335,117 | B2 | 5/2016 | Miller |
| 9,389,043 | B1 | 7/2016 | Zhang |

(56) References Cited

U.S. PATENT DOCUMENTS

| | | | |
|---|---|---|---|
| 9,453,694 | B1 | 9/2016 | Storch |
| 9,464,864 | B2 | 10/2016 | Merlino |
| 9,464,865 | B2 | 10/2016 | Shea |
| 9,476,672 | B2 | 10/2016 | Wells |
| 9,528,793 | B1 | 12/2016 | Oglesby |
| 9,557,137 | B2 | 1/2017 | Dzwill |
| 10,145,648 | B1 | 12/2018 | Holder et al. |
| 2002/0116857 | A1 | 8/2002 | Wonisch |
| 2006/0162217 | A1 | 7/2006 | Longueira |
| 2006/0260169 | A1 | 11/2006 | Samson |
| 2007/0017139 | A1 | 1/2007 | LaRue |
| 2007/0033851 | A1 | 2/2007 | Hochstrate |
| 2007/0199435 | A1 | 8/2007 | Hochstrate |
| 2007/0261285 | A1 | 11/2007 | Troy |
| 2008/0092422 | A1 | 4/2008 | Daniel |
| 2009/0013579 | A1 | 1/2009 | Fluhr |
| 2009/0044439 | A1 | 2/2009 | Phillips |
| 2010/0095575 | A1 | 4/2010 | Swan |
| 2010/0126054 | A1 | 5/2010 | Daniel |
| 2010/0175293 | A1 | 7/2010 | Hines |
| 2010/0212201 | A1 | 8/2010 | Kincel |
| 2010/0269392 | A1 | 10/2010 | Swan |
| 2010/0282066 | A1 | 11/2010 | Tankersley |
| 2010/0287809 | A1 | 11/2010 | Williams |
| 2010/0300277 | A1 | 12/2010 | Hochstrate |
| 2010/0319231 | A1 | 12/2010 | Stone |
| 2011/0000119 | A1 | 1/2011 | Desomma |
| 2011/0016762 | A1 | 1/2011 | Davies |
| 2011/0061281 | A1 | 3/2011 | Kapusta |
| 2011/0099869 | A1 | 5/2011 | Bentley |
| 2011/0119981 | A1 | 5/2011 | LaRue |
| 2011/0126443 | A1 | 6/2011 | Sirois |
| 2011/0167701 | A1 | 7/2011 | Williams |
| 2011/0192066 | A1 | 8/2011 | Kimmel |
| 2011/0214327 | A1 | 9/2011 | DeSomma |
| 2011/0239513 | A1 | 10/2011 | Sandman |
| 2011/0247254 | A1 | 10/2011 | Barnes |
| 2011/0252625 | A1 | 10/2011 | Daniel |
| 2011/0303082 | A1 | 12/2011 | Hochstrate |
| 2012/0005936 | A1 | 1/2012 | Daniel |
| 2012/0036756 | A1 | 2/2012 | Brown |
| 2012/0042557 | A1 | 2/2012 | Gomez |
| 2012/0073177 | A1 | 3/2012 | Laney |
| 2012/0096755 | A1 | 4/2012 | Griffin |
| 2012/0117845 | A1 | 5/2012 | DeSomma |
| 2012/0124880 | A1 | 5/2012 | LeClair |
| 2012/0131834 | A1 | 5/2012 | Barrett |
| 2012/0131835 | A1 | 5/2012 | Barrett |
| 2012/0132068 | A1 | 5/2012 | Kucynko |
| 2012/0137563 | A1 | 6/2012 | Ubl |
| 2012/0186123 | A1 | 7/2012 | Troy |
| 2012/0190358 | A1 | 7/2012 | Samson |
| 2012/0216439 | A1 | 8/2012 | Barrett |
| 2012/0285317 | A1 | 11/2012 | Davies |
| 2012/0317859 | A1 | 12/2012 | Brown |
| 2012/0324775 | A1 | 12/2012 | Troy |
| 2013/0019513 | A1 | 1/2013 | Telles |
| 2013/0047832 | A1 | 2/2013 | Hochstrate |
| 2013/0055613 | A1 | 3/2013 | Gomez |
| 2013/0097910 | A1 | 4/2013 | Daniel |
| 2013/0180151 | A1 | 7/2013 | Moore |
| 2013/0205637 | A1 | 8/2013 | Patel |
| 2013/0263732 | A1 | 10/2013 | Kucynko |
| 2014/0000142 | A1 | 1/2014 | Patel |
| 2014/0026459 | A1 | 1/2014 | Yan et al. |
| 2014/0033588 | A1 | 2/2014 | Laney |
| 2014/0033590 | A1 | 2/2014 | Gomez |
| 2014/0068987 | A1 | 3/2014 | Burt |
| 2014/0075817 | A1 | 3/2014 | Gomez |
| 2014/0076146 | A1 | 3/2014 | Gomez |
| 2014/0076147 | A1 | 3/2014 | LaRue |
| 2014/0076148 | A1 | 3/2014 | LaRue |
| 2014/0076152 | A1 | 3/2014 | Hochstrate |
| 2014/0115938 | A1 | 5/2014 | Jarboe |
| 2014/0130390 | A1 | 5/2014 | Giessele |
| 2014/0144059 | A1 | 5/2014 | Giessele |
| 2014/0345179 | A1 | 11/2014 | Adair |
| 2014/0373419 | A1 | 12/2014 | LeClair |
| 2015/0007477 | A1 | 1/2015 | Langevin |
| 2015/0007478 | A1 | 1/2015 | Barrett |
| 2015/0007712 | A1 | 1/2015 | Larson |
| 2015/0135572 | A1 | 5/2015 | Davies |
| 2015/0135576 | A1 | 5/2015 | Wells |
| 2015/0143730 | A1 | 5/2015 | Laney |
| 2015/0168092 | A1 | 6/2015 | Stone |
| 2015/0168095 | A1 | 6/2015 | Dubreuil |
| 2015/0168096 | A1 | 6/2015 | Miller |
| 2015/0241166 | A1 | 8/2015 | Hines |
| 2015/0247695 | A1 | 9/2015 | Jarboe |
| 2015/0247699 | A1 | 9/2015 | Davies |
| 2015/0247700 | A1 | 9/2015 | Merlino |
| 2015/0316347 | A1 | 11/2015 | Shea |
| 2015/0369555 | A1 | 12/2015 | Daniel |
| 2016/0010946 | A1 | 1/2016 | Gibbens |
| 2016/0033225 | A1 | 2/2016 | Selvetti |
| 2016/0054096 | A1 | 2/2016 | Dzwill |
| 2016/0084596 | A1 | 3/2016 | Gomez |
| 2016/0091276 | A1 | 3/2016 | Miller |
| 2016/0131447 | A1 | 5/2016 | Hochstrate |
| 2016/0153744 | A1 | 6/2016 | Teetzel |
| 2016/0169617 | A1 | 6/2016 | Daley, Jr. |
| 2016/0178316 | A1 | 6/2016 | Miller |
| 2016/0195360 | A1 | 7/2016 | Davies |
| 2016/0209166 | A1 | 7/2016 | Larson, Jr. et al. |
| 2016/0282069 | A1 | 9/2016 | Storch |
| 2016/0282083 | A1 | 9/2016 | Storch |
| 2016/0290761 | A1 | 10/2016 | Cook, Jr. |
| 2017/0059273 | A1 | 3/2017 | Geissele |
| 2017/0160048 | A1 | 6/2017 | Galletta, II |
| 2018/0306551 | A1 | 10/2018 | Reid |

FOREIGN PATENT DOCUMENTS

| | | | |
|---|---|---|---|
| CA | 2625261 | A1 | 5/2007 |
| CA | 2765149 | A1 | 12/2010 |
| CA | 2889273 | A1 | 5/2014 |
| CA | 2877197 | A1 | 7/2015 |
| CZ | 303 588 | B6 | 12/2012 |
| DE | 10 2010 023 466 | A1 | 12/2011 |
| DE | 10 2013 008 241 | A1 | 11/2014 |
| DE | 10 2013 208 770 | A1 | 11/2014 |
| EP | 1 998 134 | A2 | 12/2008 |
| EP | 1 949 014 | B1 | 1/2010 |
| EP | 2 141 441 | A2 | 1/2010 |
| EP | 2 191 224 | A2 | 6/2010 |
| EP | 2 634 522 | A1 | 9/2013 |
| EP | 2 446 214 | B1 | 1/2014 |
| EP | 2 894 431 | A1 | 7/2015 |
| EP | 2 896 927 | A1 | 7/2015 |
| GB | 891448 | | 3/1962 |
| KR | 10-2008-0034451 | | 4/2008 |
| KR | 10-2008-0034454 | | 4/2008 |
| KR | 10-2008-0036988 | | 4/2008 |
| KR | 10-2008-0067345 | | 7/2008 |
| KR | 10-2013-0076902 | | 7/2013 |
| KR | 1358970 | | 1/2014 |
| KR | 10-2014-0056391 | | 5/2014 |
| KR | 1564570 | | 10/2015 |
| WO | WO 2005/047801 | A3 | 5/2005 |
| WO | WO 2006/103062 | A1 | 10/2006 |
| WO | WO 2006/138106 | A3 | 12/2006 |
| WO | WO 2008/060310 | A3 | 5/2008 |
| WO | WO 2008/103193 | A3 | 8/2008 |
| WO | WO 2009/082520 | A3 | 7/2009 |
| WO | WO 2009/131721 | A3 | 10/2009 |
| WO | WO 2010/0151552 | | 12/2010 |
| WO | WO 2013/010515 | A1 | 1/2013 |
| WO | WO 2014/031593 | A3 | 2/2014 |
| WO | WO 2014/066759 | A1 | 5/2014 |

(56) References Cited

FOREIGN PATENT DOCUMENTS

| | | |
|---|---|---|
| WO | WO 2016/028908 A1 | 2/2016 |
| WO | WO 2016/089863 A3 | 6/2016 |

OTHER PUBLICATIONS

Abstract, Bibliographic Data for US 2010/319231 corresponding to EP2446214.
Abstract, Bibliographic Data for WO 2009/082520 corresponding to EP2191224.
Abstract, Bibliographic Data for WO2006/103062.
Abstract, Bibliographic Data for WO2006/138106 corresopnding to KR20130076902.
Aero Precision, MrE1 Handguard Barrel Nut and AR15 BAR Barrel Nut, https://aeroprecisionusa.com/catalogsearch/result/?q=M5E1+Handguard+Barrel+Nut.
Daniel Defense Bolt-Up Plate, https://danieldefense.com/catalogsearch/result/?q=bolt-up+plate.
English Abstract of CZ303588 obtained from Lexis-Nexis Total Patent on Jul. 11, 2018.
English Abstract of DE 10 2010 023 466 A1. Translation obtained from Lexis-Nexis Total Patent on Jun. 27, 2017.
English Abstract of DE 10 2013 008 241 A1. Translation obtained from Lexis-Nexis Total Patent on Jun. 27, 2017.
English Abstract of DE 10 2013 208 770 A1. Translation obtained from Lexis-Nexis Total Patent on Jun. 27, 2017.
English Abstract of KR 10-2008-0034451 obtained from Lexis-Nexit Total Patent on Jul. 11, 2018.
English Abstract of KR 10-2008-0034454 obtained from Lexis-Nexis Total Patent on Jul. 11, 2018.
English Abstract of KR 10-2008-0036988 obtained from Lexis-Nexis Total Patent on Jul. 11, 2018.
English Abstract of KR 10-2008-0067345. Translation obtained from Lexis-Nexis Total Patent on Jun. 27, 2017.
English Abstract of KR 10-2013-0076902 obtained from Lexis-Nexis Total Patent on Jan. 8, 2019.
English Abstract of WO2006/138106 A2 and KR10-1358970 (B1). Translation obtained from Lexis-Nexis total Patent on Sep. 27, 2017.
English Abstract of WO2006138106 A2 and KR10-1564570 (B1). Translation obtained from Lexis-Nexis.Total Patent on Jun. 27, 2017.
English Machine Translation of KR1358970.
English Machine Traslation of KR1564570.
English Translation of Abstract for DE102005054917.
Noveske NSR Barrel Nut, Noveske Rifleworks, L.L.C., https://www.noveske.com/search?type=product&q=NSR.
Parallax Tactical, FFSSR Rail System, https://parallaxtactical.com/search?q=FFSSR.
Seekins Precision Rail Mountain System in which a rail is attached using screws, http://www.seekinsprecision.com/parts-and-accessories/handguards.html.
Wilson Combat, Tactical Rail Interface (T.R.I.M.), http://shopwilsoncombat.com/TRIM-Tactical-Rail-Interface-Modular-126/productinfo/TR-TRIM-12/.

FREE FLOATING HANDGUARD ANCHORING SYSTEM

BACKGROUND

The present disclosure pertains generally to firearms of various actions (e.g., bolt-action, lever-action, and semi-automatic action), including, but not limited to, modern sporting rifles like the AR-15 and M-16 style weapons. Specifically, the present disclosure pertains to systems for attaching a handguard to a firearm. Handguard anchoring systems currently exist; however, there continues to be a desire and need for new designs.

SUMMARY

The present disclosure pertains generally to systems for anchoring a handguard to a firearm. In certain aspects, the systems disclosed herein include a fastener extending through the handguard and into the barrel nut. In some instances, disclosed systems comprise a barrel nut having a circumference with a plurality of openings positioned therearound; a handguard having a sidewall defining an internal cavity arranged to receive the barrel nut, the sidewall defining a side opening that exposes a first opening of the plurality of openings when the barrel nut and the handguard are mounted on the firearm; and a plate defining a plate opening arranged to receive a fastener; wherein when mounted on the firearm, the sidewall of the handguard is captured between the plate and the barrel nut and the fastener has portions positioned in the plate opening, the side opening, and the first opening of the barrel nut.

Arrangements of the disclosed systems can have a width of a portion of the fastener received within the side opening of the handguard that is at least 10% smaller, at least 20% smaller, or at least 50% smaller than a corresponding width of the side opening of the handguard so as to allow movement of the fastener from a first portion of the side opening into a second portion of the side opening as the handguard rotates about an axis of the barrel nut. In some instances, the fastener is sufficiently smaller than the side opening so as to allow rotational movement of the handguard about the barrel nut at least about the width of the fastener, before the fastener is tightly fastened for use.

The present disclosure also provides the plate can have a first portion and a second portion, the first portion smaller than and receivable within the side opening and a second portion larger than the side opening and positionable on an exterior surface of the handguard; wherein the side opening of the handguard has a length and a width; wherein the first portion of the plate has a length and a width; and/or wherein the first portion is sufficiently smaller than the side opening of the handguard so as to allow movement of the first portion of the plate from a first section of the side opening into a second section of the side opening when positioned therein.

The plates of the present disclosure can include a first portion having a width that is at least 10% smaller, at least 20% smaller, or at least 50% smaller than a corresponding width of the side opening in the handguard so as to allow movement of the first portion of the plate from a first section of the side opening into a second section of the side opening as the handguard rotates about an axis of the barrel nut.

In the disclosed embodiments, the length of the side opening can be greater than the width of the side opening. Additionally or alternatively, the length of the first portion of the plate can be greater than the width of the second portion of the plate so as to allow longitudinal movement of the plate relative to the handguard when the fasteners are loose. Embodiments may also have the length of the second portion of the plate being greater than the width of the second portion of the plate. In some instances the ratio of length:width of the first portion of the plate is greater than a ratio of length:width of the side opening.

In the disclosed embodiments, the barrel nut can have a longitudinal axis along which a barrel of the firearm is received and each opening of the plurality of openings has an axis. In some of such arrangements, the axes of the individual openings extend transverse to the longitudinal axis. For example, the plurality of openings can extend along directions orthogonal to the longitudinal axis.

The plurality of openings are spaced around the circumference of the barrel nut and can be arranged in one or more rows around the barrel nut. For example, the plurality of openings may be arranged in two or more rows. One or more rows (e.g., each row) can extend circumferentially around the barrel nut. In some preferred embodiments, one or more rows (e.g., each row) includes 20 or more openings.

The openings are, preferably, evenly spaced around the circumference of the barrel nut. Additionally, in many embodiments it may be preferred to have an even number of openings spaced around the circumference of the barrel nut such that openings are diametrically opposed in pairs. Advantageously, such an arrangement allow for pairs of openings to be presented in diametrically opposed openings in the handguard when received therein. While not limited to such, the plurality of openings of the barrel nut can be a plurality of threaded openings and the fastener can be a threaded fastener.

The fastener(s) of the disclosed embodiments can have a first end and a second end, the first end positionable in the at least one of the plurality of openings in the barrel nut and the second end (e.g., a head) having a cross-sectional dimension greater than a cross-sectional dimension of the plate opening and/or the side opening. In some instances, the fastener may have a first end and a second end, the first end positionable in the at least one of the plurality of openings in the barrel nut; wherein the plate opening is countersunk or counterbored to receive the second end of the fastener; and wherein the second end of the threaded fastener does not protrude beyond the plate when the system is mounted on a firearm.

In the disclosed embodiments, a width of a portion of the fastener positioned within the plate opening when the system is attached to a firearm can be at least 10% smaller, at least 20% smaller, or at least 50% smaller than a corresponding width of the plate opening so as to allow movement of the fastener from a first portion of the plate opening into a second portion of the plate opening as the handguard and/or plate rotate relative to the barrel nut.

The disclosed embodiments may have non-circular side openings of the handguard for receipt of the fastener(s) and/or plates. Additionally or alternatively, the plate openings that receive the fastener(s) may be non-circular. For example, side openings and/or plate openings may be elongated. In some embodiments, side openings and/or plate openings may be rectangular, oval, or obround, just to name a few non-limiting examples.

The present disclosure also provides systems for a firearm, comprising: a barrel nut having a circumference with a plurality of openings positioned therearound; and a handguard having a sidewall defining an internal cavity arranged to receive the barrel nut, the sidewall defining a side opening that exposes a first opening of the plurality of openings when the barrel nut and the handguard are mounted on the firearm;

wherein when mounted on the firearm, the sidewall of the handguard is captured between a head of a fastener and the barrel nut and the fastener has a portion positioned in the side opening and a portion positioned the first opening of the barrel nut; and wherein the side opening of the handguard is non-circular. The features of these systems may be combined and/or replaced with any number of features and combinations of features disclosed elsewhere.

Embodiments of the present disclosure can allow movement of the handguard relative to a barrel nut while a fastener extends through the handguard into the barrel nut. The embodiments, however, can be configured to resist rotation of the handguard relative to the barrel nut by tightening the fasteners so as to press a segment of the handguard against the barrel nut. Advantageously, disclosed arrangements can allow for further adjustment of the handguard relative to the barrel nut after the fasteners have been inserted through the handguard and into the barrel nut. This new system is believed to provide easier and, in at least some instances, better alignment of the handguard with the upper receiver of the firearm than many existing handguard attachment systems. For example, the system of the present can be arranged so as to reduce and/or avoid the use of shims.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
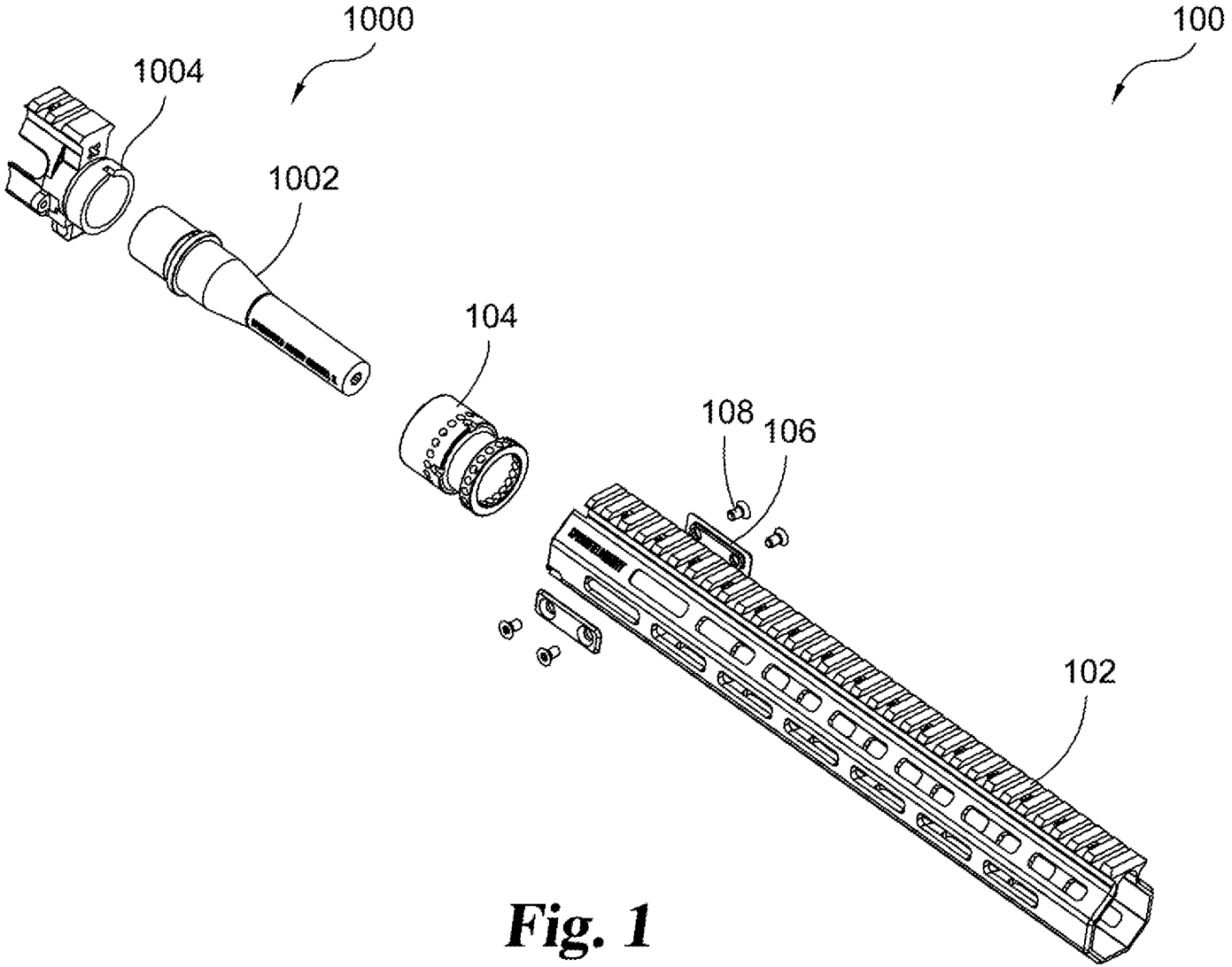
FIG. 1 is an exploded view of a handguard anchoring system, barrel portion, and upper receiver portion.
Figure 2:
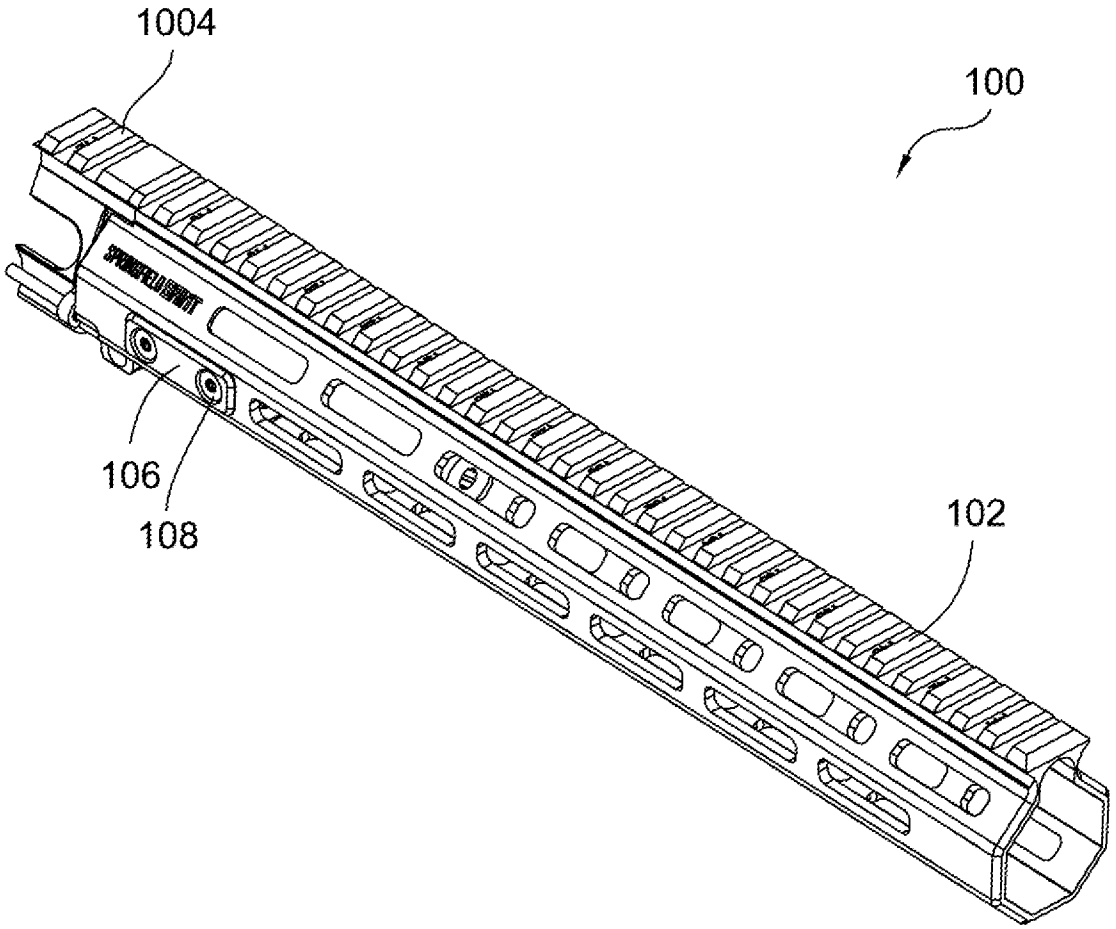
FIG. 2 is a perspective view of the system of FIG. 1.
Figure 3:
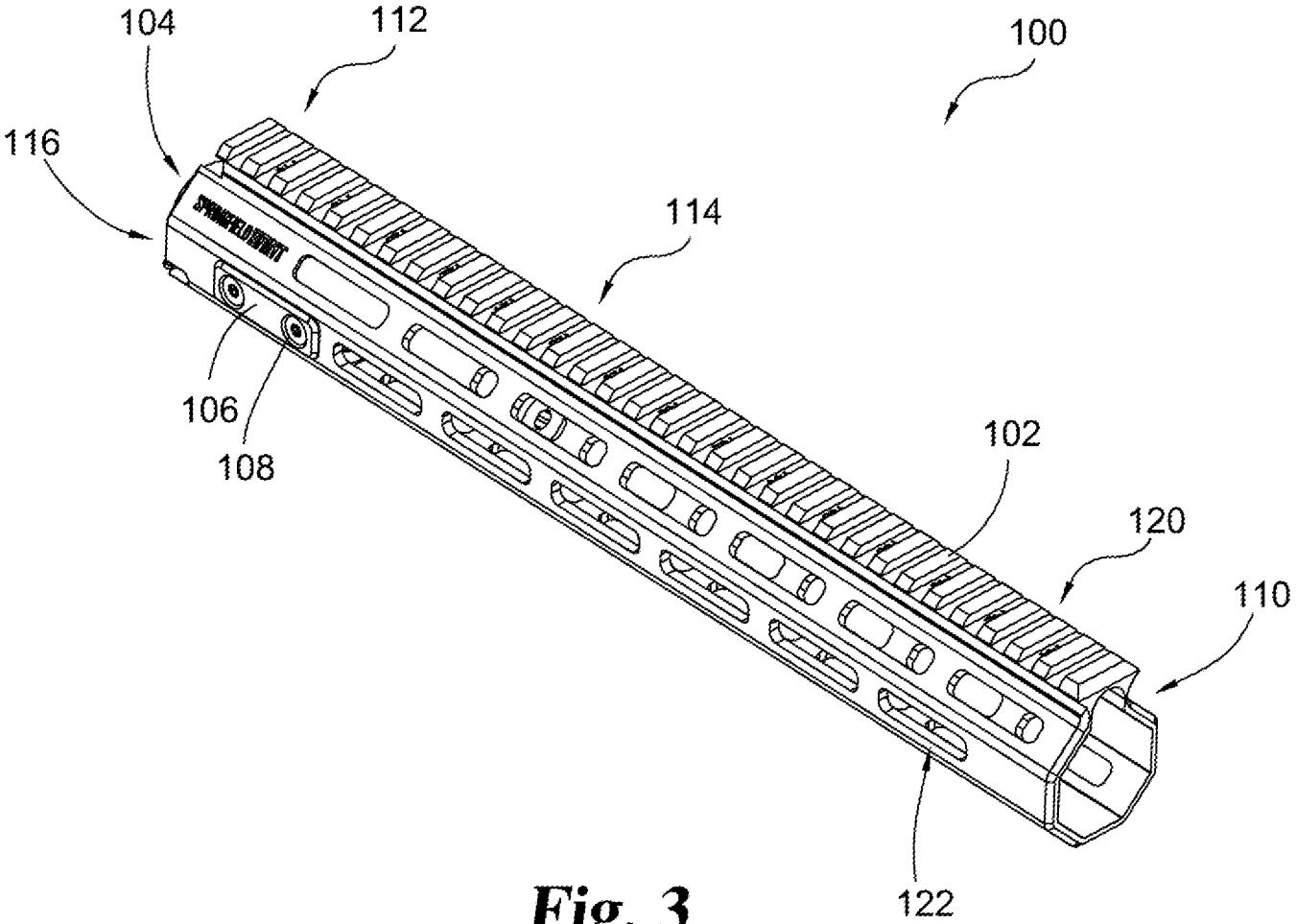
FIG. 3 is a perspective view of the handguard anchoring system of FIG. 1.
Figure 4:
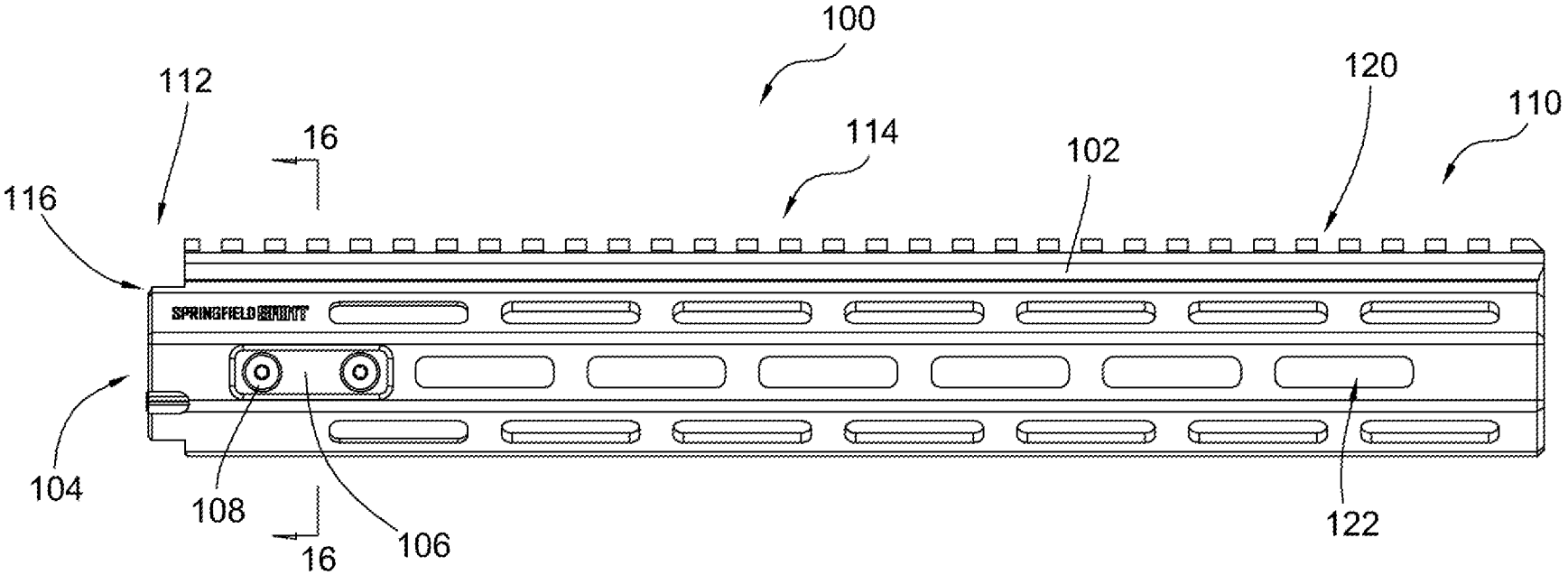
FIG. 4 is a side view of the system of FIG. 3.
Figure 5:
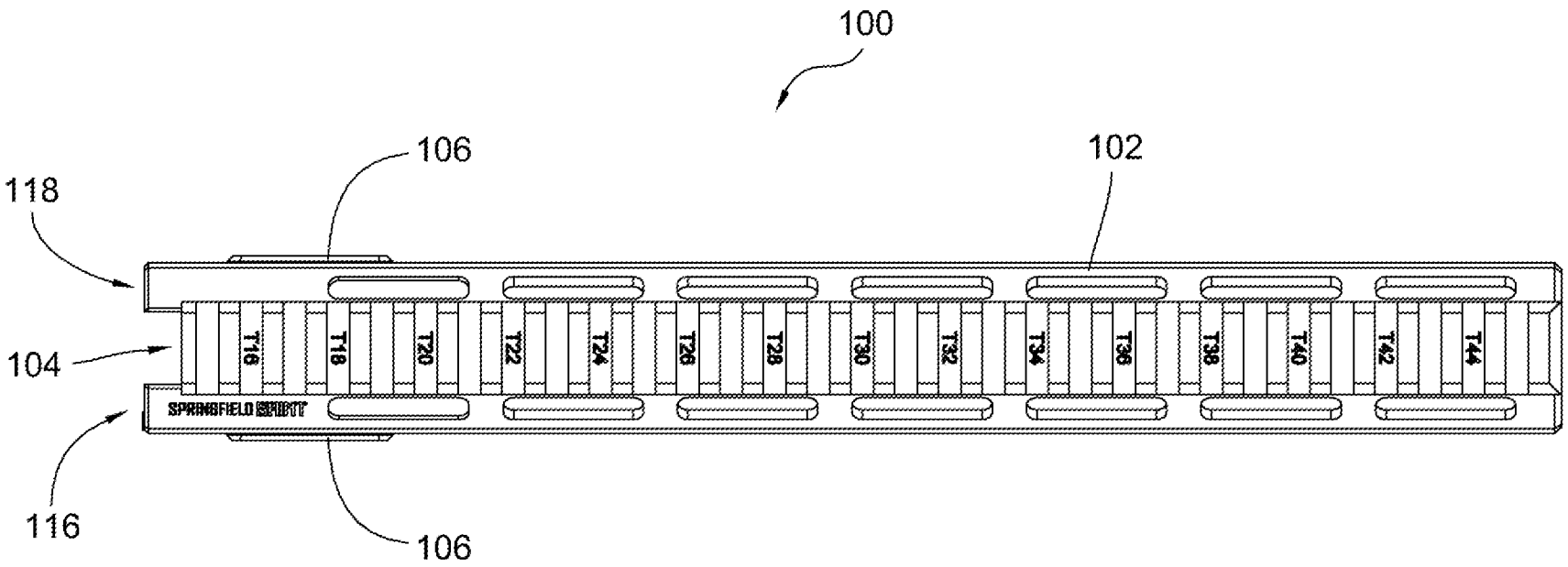
FIG. 5 is a top view of the system of FIG. 3.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail; although it will be apparent to those skilled in the relevant art that some features that are not relevant to the present invention may not be shown for the sake of clarity.

An exemplary handguard anchoring system 100 useful for attaching a handguard to a firearm 1000 is illustrated in the figures. The handguard anchoring system includes a handguard 102, a barrel nut 104, an anchoring plate 106, and a fastener 108. The handguard anchoring system is useful for attaching handguard 102 around a barrel 1002 that is secured to an upper receiver 1004 by the barrel nut.

The handguard has a forward end 110, a rearward end 112, and an intermediate region 114 extending between the forward and rearward ends. The rearward end of the handguard has one or more tabs 116, 118 arranged to fit alongside a portion of the upper receiver 1004 when the handguard has been system is attached to a firearm. Advantageously, once the handguard anchoring system is attached to a firearm, the one or more tabs of the handguard may aid in resisting rotation of the handguard relative to the upper receiver.

The handguard may include one or more different mounting features arranged for attaching an accessory to the firearm. For example, a first mounting feature 120 may include a rail, such as a weaver or picatinny rail, for the attachment of, for example, a flip-up front sight. A second mounting feature 122 of a different type than the first mounting feature may include a slot/hole type mounting arrangement such as an M-LOK® or MOE slot as marketed by MagPul Industries or a KeyMod slot as marketed by VLTOR Weapon Systems and Noveske Rifleworks.

At the rearward end, the handguard has a sidewall 128 with an inner surface 130 defining an internal cavity 132 arranged to receive the barrel nut. In many embodiments, the internal cavity substantially matches the shape and size of an exterior surface of the received portion of the barrel nut. For instance, the inner surface of the handguard may define a substantially round internal cavity to receive a round barrel nut.

Figure 8:
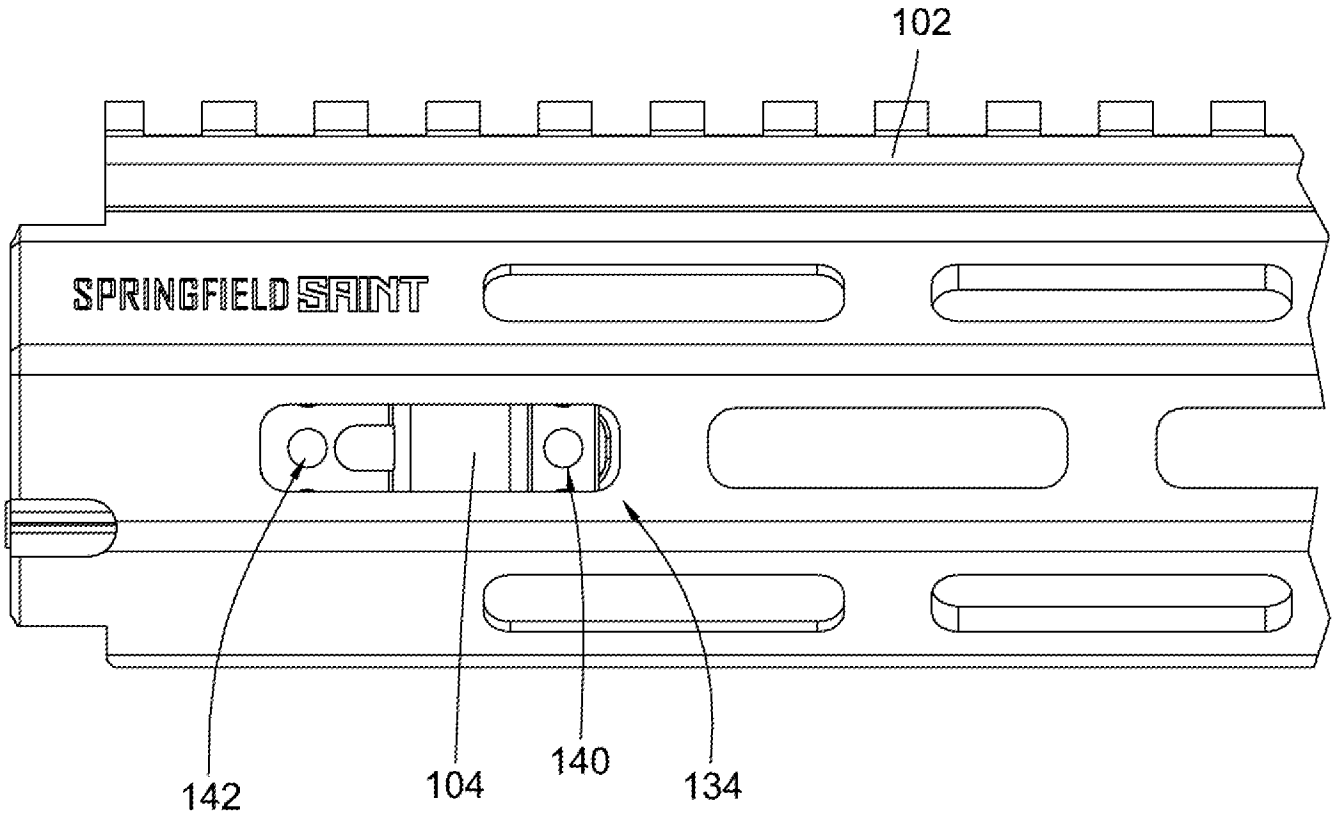
FIG. 8 is a side view of a portion of the handguard and barrel nut assembly, with the plate and fasteners omitted for illustrative purposes.

The sidewall of the rearward end of the handguard also defines a side opening 134 that communicates with the internal cavity arranged to receive the barrel nut. FIG. 8 shows a side view of the handguard anchoring system without the plate and fasteners when the barrel nut is received in the internal cavity. As can be seen, a forward opening 140 and a rearward opening 142 in the barrel nut for receiving the fasteners are positioned within the side opening when the barrel nut is received within the handguard.

Figure 9:
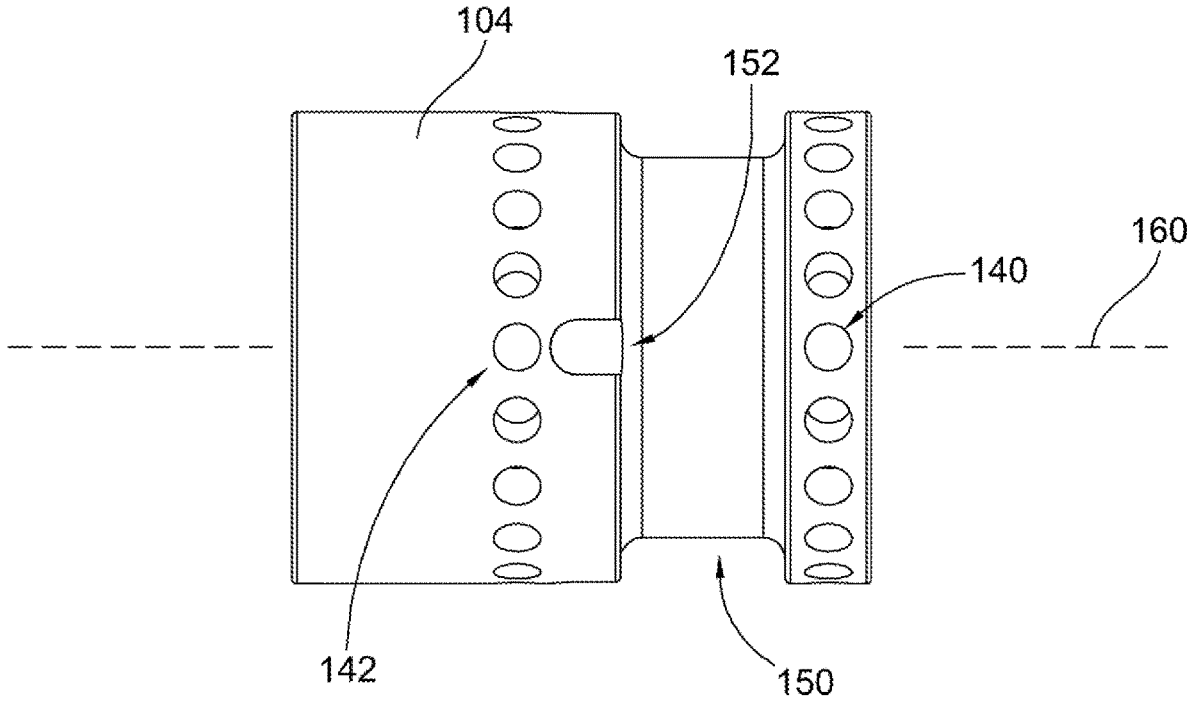
FIG. 9 is a side view of a barrel nut.
Figure 10:
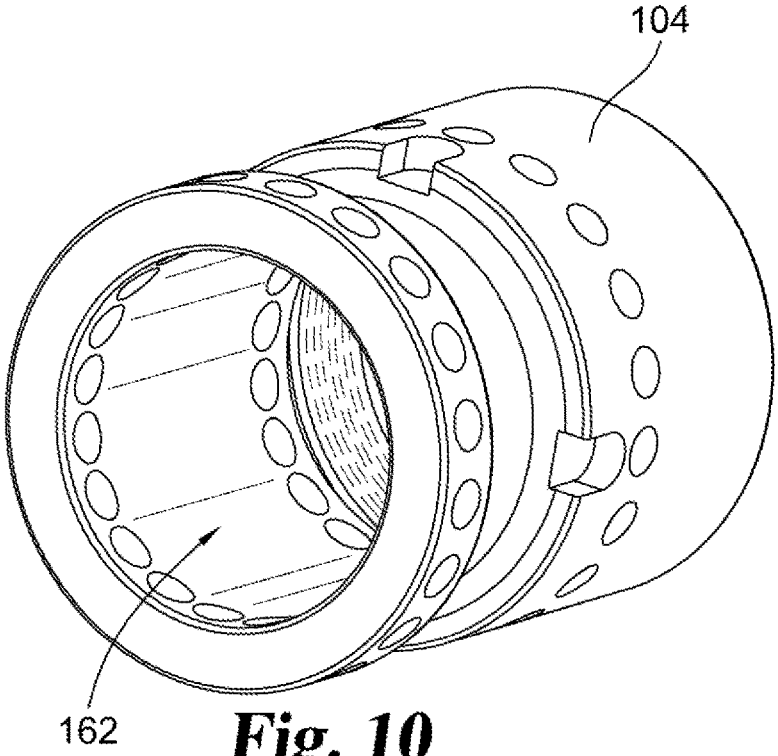
FIGS. 10 and 11 are perspective views of the barrel nut of FIG. 9.
Figure 11:
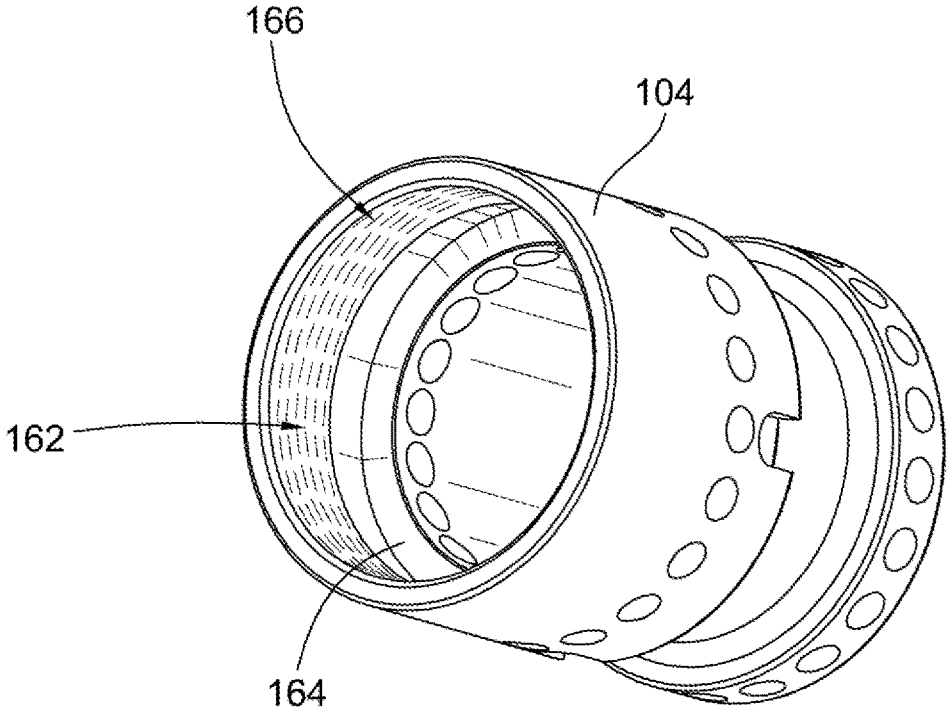

Notably, the cross-sectional dimension of the side opening in the handguard is larger than the opening(s) for receiving the fastener(s) in the barrel nut. As illustrated in FIGS. 9-11, the barrel nut has a plurality of openings positioned around the periphery thereof. In some instances, the openings in the barrel nut and the side opening in the handguard are arranged such that, regardless of the rotational position of the barrel nut inside of the handguard, at least one or more openings are completely visible through the side opening of the handguard. As will be appreciated by those of skill in the art, the openings may be threaded openings for receiving threaded fasteners.

In additional to openings for receiving the fastener(s) of the handguard anchoring system, the barrel nut can include features arranged to mate with a tool useful for securing the barrel nut to the upper receiver. For example, the barrel nut in the illustrated embodiments includes a groove 150 and notches 152 arranged to receive a barrel nut wrench. Other arrangements, however, are contemplated. For example, the barrel nut may have polygonal cross-sectional shape defined by planar surfaces around the periphery arranged to cooperate with pliers or a wrench (e.g., an open-end wrench).

The barrel nut has a longitudinal axis 160 along which the barrel of the firearm is received. When positioned around a barrel, the barrel extends through aperture 162. An internal rim 164 of the barrel nut is arranged to contact a flange of the barrel and sandwich the flange between the rim and the upper receiver when the barrel nut is secured to the upper receiver, such as with threads 166.

Figure 12:
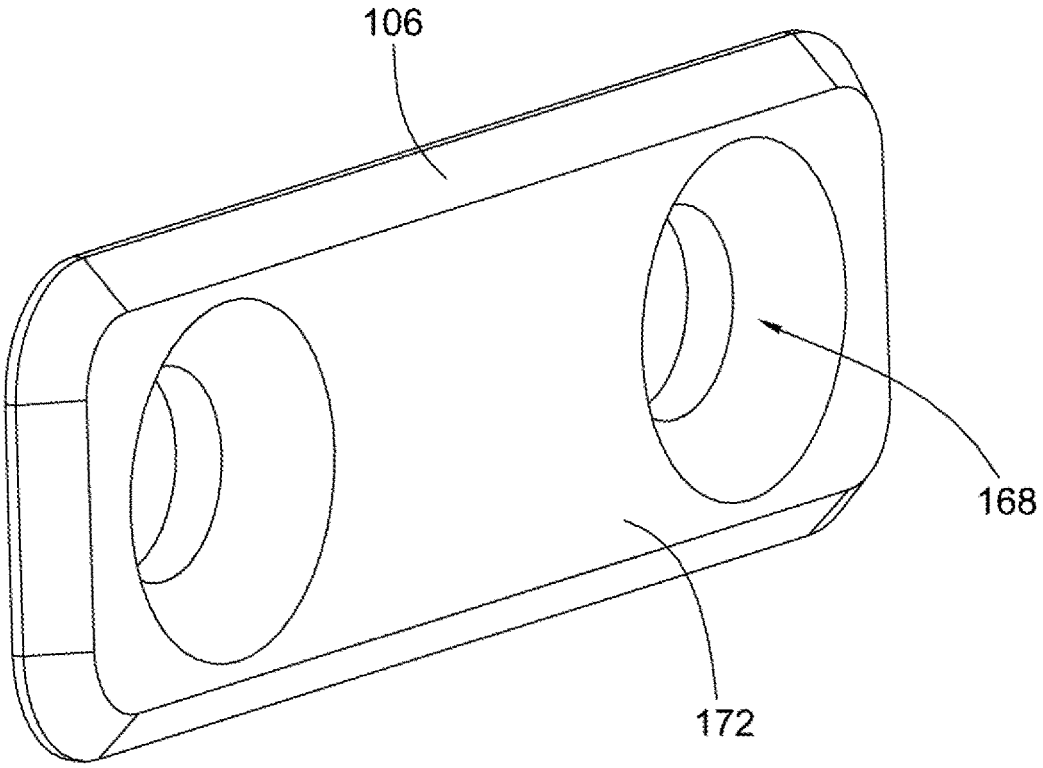
FIGS. 12 and 13 are perspective views of an anchoring plate.
Figure 13:
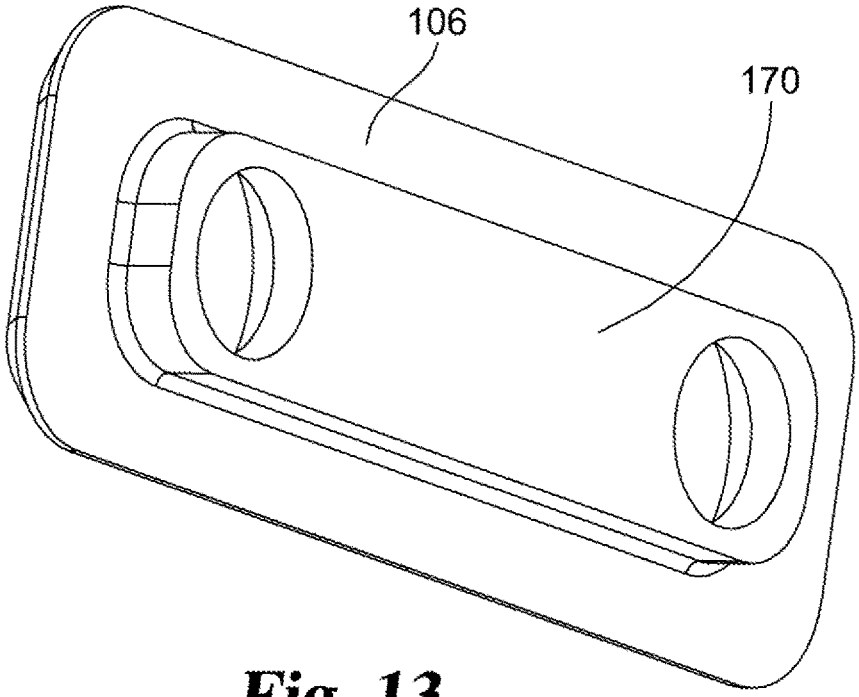
Figure 14:
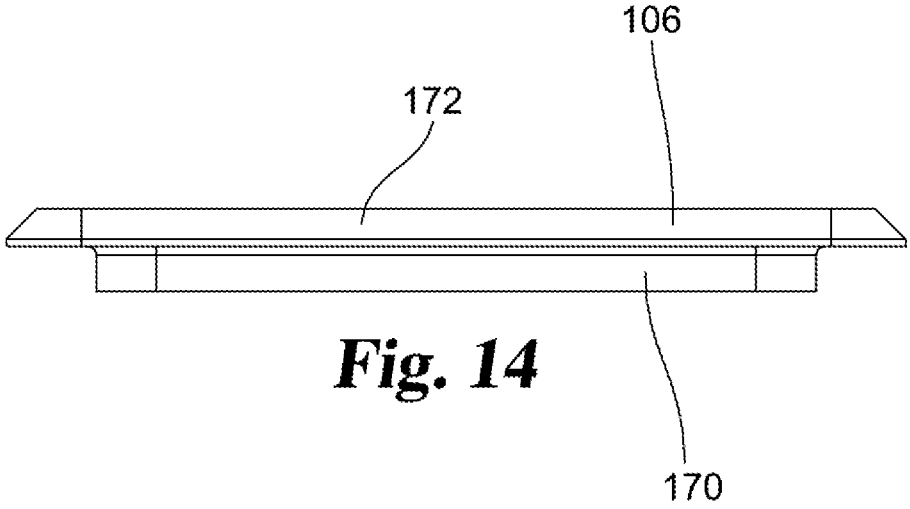
FIG. 14 is a side view of the plate of FIGS. 12 and 13.

The plate of the handguard anchoring system is illustrated in FIGS. 12-14. The plate defines one or more openings 168 arranged to receive a fastener and includes a first portion 170 and a second portion 172. The first portion has at least one outer dimension that is smaller than a corresponding outer dimension of the second portion. For example, the first portion may have a width and/or length less than the width and/or length of the second portion.

The first portion can be smaller than the corresponding side opening of the handguard such that the first portion of the plate is receivable within the side opening when the plate is positioned over the side opening. Additionally, the second portion of the plate may have at least one dimension that is larger than the side opening of the handguard such that the second portion can span a portion of the side opening and be positionable on portions of the exterior surface of the handguard on opposing sides and/or ends of the side opening.

Figure 6:
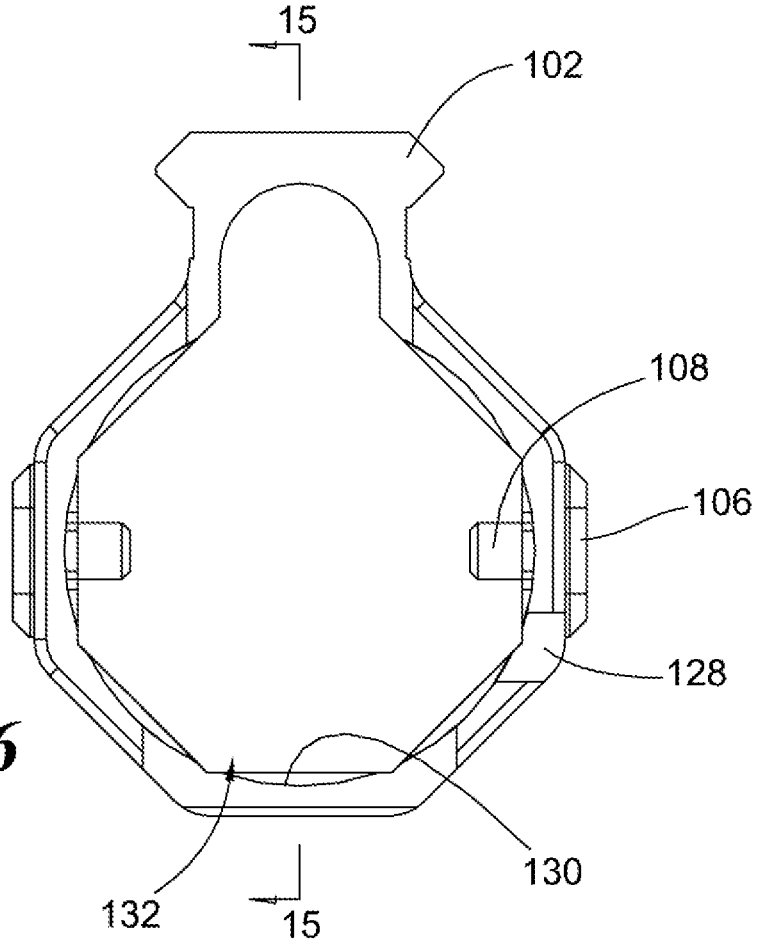
FIG. 6 is an end view of a handguard, plate, and fastener assembly, with the barrel nut omitted for illustrative purposes.
Figure 7:
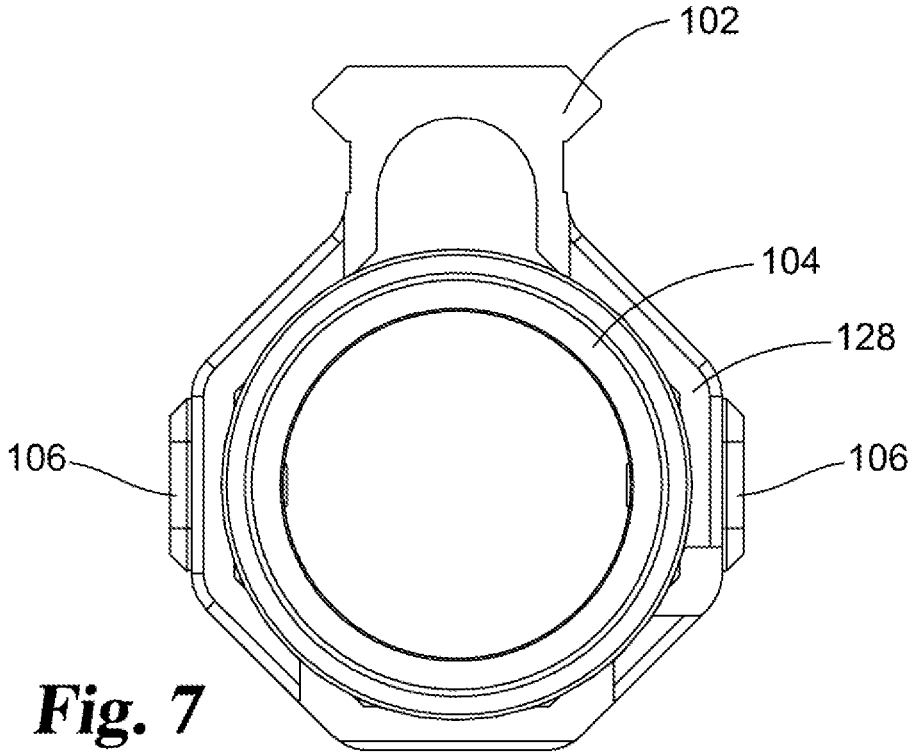
FIG. 7 is an end view of the system of FIG. 3.
Figure 15:
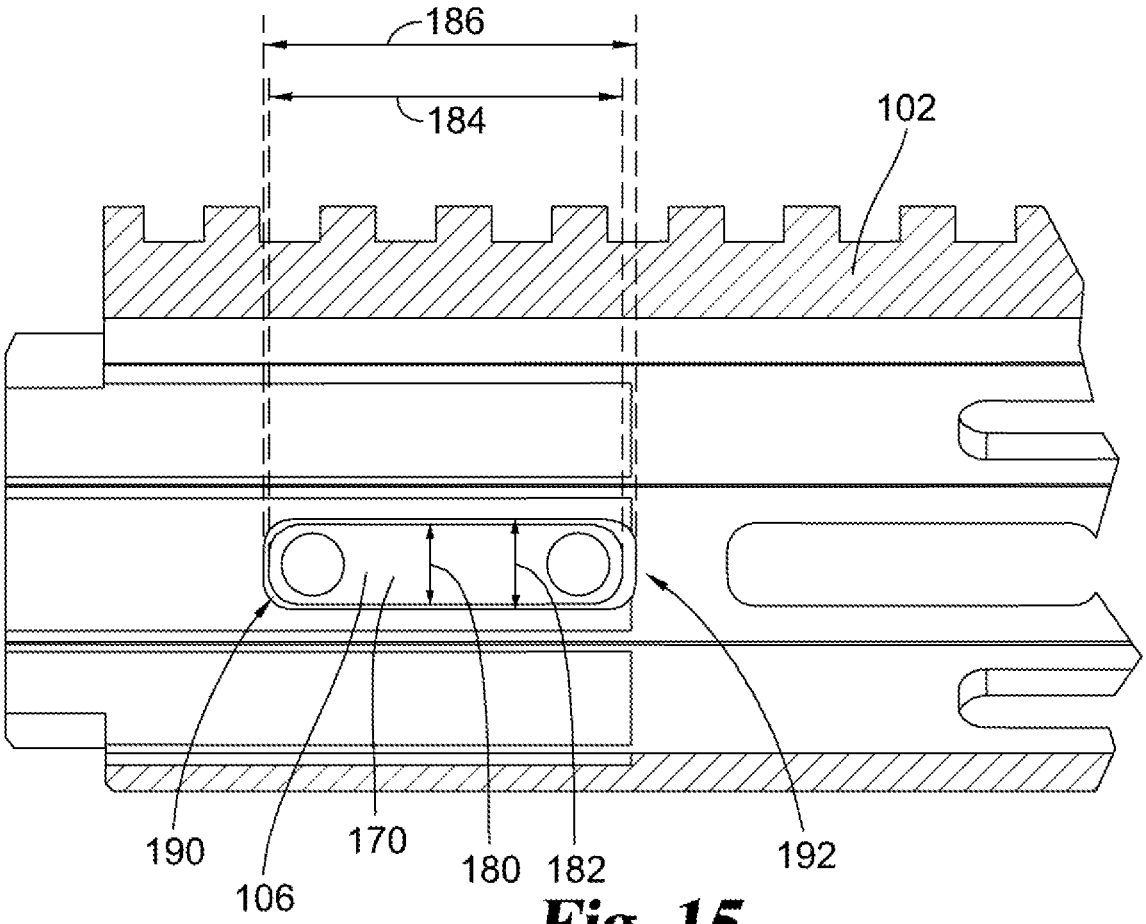
FIG. 15 is a cross-sectional view of the handguard along line 15-15 of FIG. 6.

FIG. 15 illustrates a partial cross-sectional view of the handguard and plate taken along line 15-15 of FIG. 6. As can be seen in FIG. 15, the first portion of the plate has a smaller width 180 than a width 182 of the side opening. Preferably, the width of first portion of the plate is sufficiently smaller than the width of the side opening so as to allow rotational adjustability of the handguard relative to the barrel nut prior to tightening of the fasteners. Once the handguard is rotationally aligned with the upper receiver (e.g., the rail of the handguard aligned with the rail of the upper receiver), the fasteners can be tightened to compress the handguard between the anchor plate and the barrel nut and, thereby, lock the handguard in position relative to the barrel nut.

The first portion of the plate also has a shorter length 184 than a length 186 of the side opening. Preferably, the length of first portion of the plate is sufficiently smaller than the length of the side opening so as to allow longitudinal adjustability of the handguard relative to the barrel nut prior to tightening of the fasteners. Accordingly, before the fasteners are tightly fastened, the first portion of the plate is capable of movement from a first section of the side opening, such as end 190, to a second section of the side opening, such as end 192. Advantageously, this adjustability can allow a user to adjust the spacing between the handguard and the upper receiver (e.g., move the handguard into abutting contact with the upper receiver) prior to tightening the fasteners.

Figure 16:
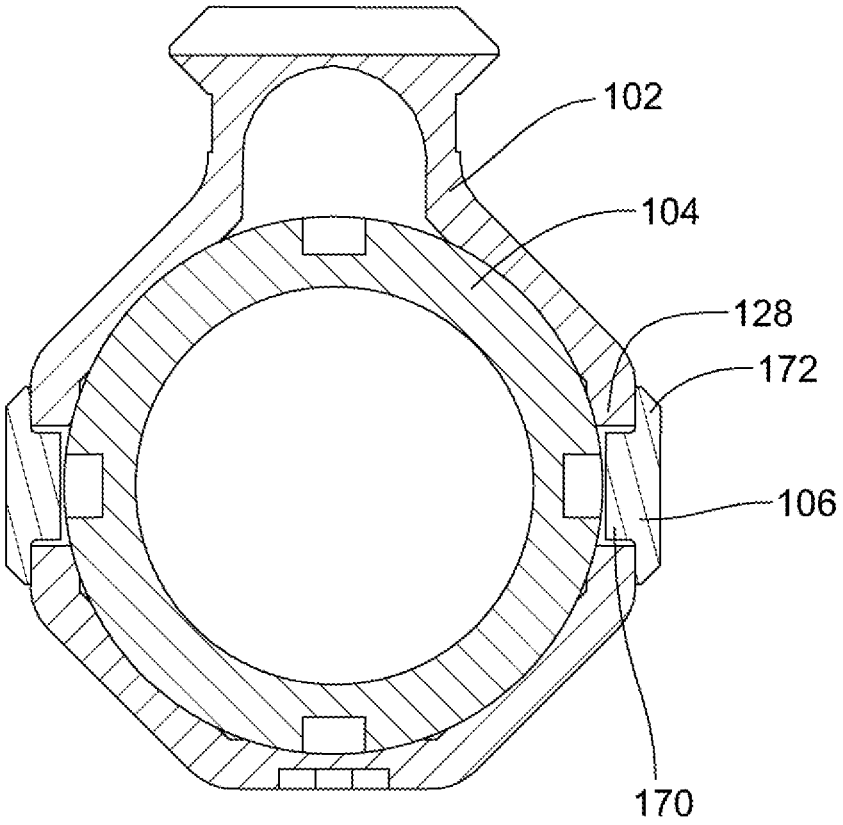
FIG. 16 is a cross-sectional view of the handguard assembly along line 16-16 of FIG. 4.

When the barrel nut is positioned inside the handguard and the plate is positioned over the side opening, the sidewall of the handguard is positioned between the barrel nut and the second portion of the plate, as shown in FIG. 16. As a fastener extending from the plate opening into the opening in the barrel nut is tightened, the fastener forces the plate against the sidewall of the handguard which, in turn, forces the handguard against the barrel nut. In this way, the handguard is securely fastened to the barrel nut.

In some embodiments, the anchoring system is arranged so that the fastener has an outer end (e.g., the head) positioned flush with or beneath the outer surface of the second portion of the plate when the handguard attachments system is secured to a firearm. This can be advantageous to some users as it can reduce the possibility of an edge of the fastener catching a shooters skin or clothing.

The handguard, barrel nut, fasteners, and/or plates described herein can be made of a variety of metals and/or polymers, including composite materials. For example, the handguard, barrel nut, fasteners, and/or plates may comprise a metal such as steel, aluminum, titanium, or magnesium, or a composite material such as carbon fiber.

In some embodiments, the handguard may comprise a first material and the plate(s) comprise a second material. For example, the handguard may comprise aluminum, magnesium, or carbon fiber and the plate(s) may comprise steel. Alternatively, the handguard may comprise magnesium or carbon fiber and the plate may comprise aluminum. It is contemplated, however, that the handguard and plates may comprise the same material, such as aluminum.

In any of the embodiments described herein the barrel nut may comprise a metal, such as steel or titanium. Barrel nuts disclosed herein may also be substantially longer than those typically found on similar firearms. For example, barrel nuts disclosed herein may have a length of more than 1 inch (e.g., 1.5 inches or more). A longer barrel nut can provide greater spacing between the openings in the barrel nut that receive the fasteners. Advantageously, this can provide greater resistance to bending of the plate and/or handguard. Moreover, a longer barrel nut can aid in the axial alignment of the handguard to the barrel.

Assemblies may include one or more plates and accompanying fasteners to secure the handguard to the barrel nut. In arrangements having more than one plate, the plates are preferably spaced from one another. For example, assemblies may have a first plate on a first side of the handguard (e.g., right side) and a second plate on a second side of the handguard (e.g., left side). Additionally or alternatively, assemblies may have plates on the top and/or bottom of the handguard.

The anchoring system can be arranged such that neither the plate nor the fasteners protrude beyond the outer surface of the handguard by more than 2 millimeters when assembled on a firearm. In some instances, an outer periphery of the plate is chamfered such that the outward facing surface of the plate, when positioned on a handguard, is free of edges defined by right angles or acute angles. Moreover, in some instance, the openings in the plate for receiving the fasteners are countersunk so the head of the fastener resides below the outermost surface of the plate. Advantageously, such arrangements can reduce the possibility of the anchoring system becoming caught on a shooter's glove, firearm sling, and/or clothing (e.g., sleeve).

The plate, fasteners, and/or barrel nut disclosed herein may be provided in a kit. For example, a kit may contain a handguard, a barrel nut, two or more plates, and/or fasteners (e.g., two fasteners per plate). Some kits may include three or more plates. Kits may also include other components such as a thread locker (e.g., thread locker sold under the name Loctite® by Henkel Corporation) and/or a paint pen or marker for an operator to use to mark the fastener and plate after tightening. Such markings can be used to indicate subsequent loosening of the fasteners.

The anchoring system may also be provided with other firearm components and/or a complete firearm. For example, an upper receiver and/or a barrel assembly for an AR-15 style pistol or rifle may be provided with a handguard and the anchoring system disclosed herein. In some instances, the handguard anchoring system may be provided on an assembled firearm.

The following numbered clauses set out specific embodiments that may be useful in understanding the present invention:

1. A system for a firearm, comprising:

a barrel nut having a circumference with a plurality of openings positioned therearound;

a handguard having a sidewall defining an internal cavity arranged to receive the barrel nut, the sidewall defining a side opening that exposes a first opening of the plurality of openings when the barrel nut and the handguard are mounted on the firearm; and a plate defining a plate opening arranged to receive a fastener;

wherein when mounted on the firearm, the sidewall of the handguard is captured between the plate and the barrel nut and the fastener has portions positioned in the plate opening, the side opening, and the first opening of the barrel nut.

2. The system of clause 1, wherein when the system is mounted on the firearm a width of a portion of the fastener received within the side opening of the handguard is at least 10% smaller than a corresponding width of the side opening of the handguard so as to allow movement of the fastener from a first portion of the side opening into a second portion of the side opening as the handguard rotates about an axis of the barrel nut.

3. The system of clause 1, wherein when the system is mounted on the firearm a width of a portion of the fastener received within the side opening of the handguard is at least 20% smaller than a corresponding width of the side opening in the handguard so as to allow movement of the fastener from a first portion of the side opening into a second portion of the side opening as the handguard rotates about an axis of the barrel nut.

4. The system of clause 1, wherein when the system is mounted on the firearm a width of a portion of the fastener received within the side opening of the handguard is at least 50% smaller than a corresponding width of the side opening, so as to allow rotational movement of the handguard about the barrel nut at least about the width of the fastener before the fastener is tightly fastened for use.

5. The system of any preceding clause, wherein the plate has a first portion and a second portion, the first portion smaller than and receivable within the side opening and a second portion larger than the side opening and positionable on an exterior surface of the handguard;

wherein the side opening of the handguard has a length and a width;

wherein the first portion of the plate has a length and a width; and wherein the first portion is sufficiently smaller than the side opening of the handguard so as to allow movement of the first portion of the plate from a first section of the side opening into a second section of the side opening when positioned therein.

6. The system of clause 5, wherein when the system is mounted on the firearm the width of the first portion of the plate is at least 10% smaller than a corresponding width of the side opening in the handguard so as to allow movement of the first portion of the plate from a first section of the side opening into a second section of the side opening as the handguard rotates about an axis of the barrel nut.

7. The system of clause 5, wherein when the system is mounted on the firearm the width of the first portion of the plate is at least 20% smaller than a corresponding width of the side opening in the handguard so as to allow movement of the first portion of the plate from a first section of the side opening into a second section of the side opening as the handguard rotates about an axis of the barrel nut.

8. The system of any one of clause 5-7, wherein the length of the side opening is greater than the width of the side opening.

9. The system of any one of clauses 5-8, wherein the length of the first portion of the plate is greater than the width of the first portion of the plate.

10. The system of any one of clause 5-9, wherein the length of the second portion of the plate is greater than the width of the second portion of the plate.

11. The system of any one of clauses 5-10, wherein the side opening has a length and a width; and wherein a ratio of length:width of the first portion of the plate is greater than a ratio of length:width of the side opening.

12. The system of any preceding clause, wherein the barrel nut has a longitudinal axis along which a barrel of the firearm is received; and wherein each opening of the plurality of openings has an axis, and the axes of the individual openings extend transverse to the longitudinal axis.

13. The system of clause 12, wherein the plurality of openings extend along directions orthogonal to the longitudinal axis.

14. The system of any preceding clause, wherein the plurality of openings are a plurality of threaded openings and the fastener is a threaded fastener.

15. The system of any preceding clause, wherein the fastener has a first end and a second end, the first end positionable in the at least one of the plurality of openings in the barrel nut and the second end having a cross-sectional dimension greater than a cross-sectional dimension of the plate opening.

16. The system of any preceding clause, wherein the fastener has a first end and a second end, the first end positionable in the at least one of the plurality of openings in the barrel nut;

wherein the plate opening is countersunk or counterbored to receive the second end of the fastener; and wherein the second end of the threaded fastener does not protrude beyond the plate when the system is mounted on a firearm.

17. The system of any preceding clause, wherein a width of a portion of the fastener positioned within the plate opening when the system is attached to a firearm is at least 10% smaller than a corresponding width of the plate opening so as to allow movement of the fastener from a first portion of the plate opening into a second portion of the plate opening as the handguard and plate rotate about an axis of the barrel nut.

18. The system of any preceding clause, wherein the side opening of the handguard is non-circular.

19. The system of any preceding clause, wherein the plate opening is non-circular.

20. The system of any preceding clause, wherein the plate opening is elongated.

21. The system of any preceding clause, wherein the plate opening is rectangular, oval, or obround.

22. A system for a firearm, comprising:

a barrel nut having a circumference with a plurality of openings positioned therearound; and a handguard having a sidewall defining an internal cavity arranged to receive the barrel nut, the sidewall defining a side opening that exposes a first opening of the plurality of openings when the barrel nut and the handguard are mounted on the firearm;

wherein when mounted on the firearm, the sidewall of the handguard is captured between a head of a fastener and the barrel nut and the fastener has a portion positioned in the side opening and a portion positioned the first opening of the barrel nut; and wherein the side opening of the handguard is non-circular.

23. The system of any preceding clause, wherein the side opening is elongated.

24. The system of any preceding clause, wherein the side opening is rectangular, oval, or obround.

While the invention has been illustrated and described in detail in the drawings and foregoing description, the same is to be considered as illustrative and not restrictive in character, it being understood that only the preferred embodiment has been shown and described. For example, arrangements of the handguard anchoring system may include a barrel nut and a handguard with a non-circular side opening arranged to receive a fastener passing into the barrel nut. In such arrangements, the head of the fastener may have a cross-sectional dimension that is greater than a corresponding cross-sectional dimension of the side opening such that a portion of the sidewall of the handguard is compressed between the fastener and the barrel nut when the fastener is tightened. Such an arrangement would also be configured to allow for rotational movement of the handguard relative to the barrel nut while a portion of the fastener is positioned in the side opening of the handguard.

All changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A system for a firearm, comprising:

a barrel nut having a circumference with a plurality of openings positioned therearound; and a handguard having a sidewall with an exterior surface and an interior surface and defining an internal cavity arranged to receive the barrel nut, the sidewall defining a side opening that extends from the exterior surface to the interior surface and that exposes a first opening of the plurality of openings when the barrel nut and the handguard are mounted on the firearm;

wherein when mounted on the firearm, the sidewall of the handguard is captured between a head of a fastener and the barrel nut and the fastener has a portion positioned in the side opening and a portion positioned in the first opening of the barrel nut; and wherein the side opening of the handguard is non-circular.

2. The system of claim 1, wherein the side opening is elongated.

3. The system of claim 1, wherein the side opening is rectangular, oval, or obround.

4. The system of claim 1, wherein the first opening has a width at least 10% smaller than a corresponding width of the side opening of the handguard.

5. The system of claim 1, wherein the first opening has a width at least 20% smaller than a corresponding width of the side opening of the handguard.

6. The system of claim 1, wherein the first opening has a width at least 50% smaller than a corresponding width of the side opening of the handguard.

7. The system of claim 1, wherein when the barrel nut and handguard are mounted on the firearm at least two openings of the plurality of openings are exposed in said side opening.

8. The system of claim 7, wherein said at least two openings are aligned along said longitudinal axis of the barrel nut.

9. The system of claim 7, wherein said side opening is a first side opening and said sidewall defines a second side opening diametrically opposed to said first side opening relative to the internal cavity.

10. The system of claim 9, wherein when mounted on the firearm, the second side opening exposes a second opening of the plurality of openings when the barrel nut and the handguard are mounted on the firearm and when the first side opening exposes said first opening of the plurality of openings.

11. A system for a firearm, comprising:

a barrel nut having a circumference with a plurality of openings positioned therearound; and a handguard having a sidewall having an exterior surface and an interior surface and defining an internal cavity arranged to receive the barrel nut, the sidewall defining a side opening that extends from the exterior surface to the interior surface;

wherein the side opening exposes at least two openings of the plurality of openings when the barrel nut and the handguard are mounted on the firearm; and wherein when mounted on the firearm, the sidewall of the handguard is captured between a head of a fastener and the barrel nut and the fastener has a portion positioned in the side opening and a portion positioned in a first opening of the at least two openings of the barrel nut.

12. The system of claim 11, wherein said at least two openings are aligned along said longitudinal axis of the barrel nut.

13. The system of claim 11, wherein each of said at least two openings has a width at least 10% smaller than a corresponding width of the side opening of the handguard.

14. The system of claim 11, wherein each of said at least two openings has a width at least 20% smaller than a corresponding width of the side opening of the handguard.

15. The system of claim 11, wherein each of said at least two openings has a width at least 50% smaller than a corresponding width of the side opening of the handguard.

16. The system of claim 11, wherein the side opening is elongated.

17. The system of claim 11, wherein the side opening is rectangular, oval, or obround.

18. The system of claim 11, wherein said side opening is a first side opening and said sidewall defines a second side opening diametrically opposed to said first side opening relative to the internal cavity.

19. The system of claim 18, wherein said at least two openings are a first group of openings and when mounted on the firearm the second side opening exposes a second group of openings comprising at least two openings of the plurality of openings when the barrel nut and the handguard are mounted on the firearm and when the first side opening exposes said first group of openings.

* * * * *